US007926216B2

(12) United States Patent
Bentley

(10) Patent No.: US 7,926,216 B2
(45) Date of Patent: Apr. 19, 2011

(54) RECOIL SUPPRESSION SYSTEM FOR THE STOCK OF A FIREARM

(75) Inventor: James K. Bentley, Meridian, ID (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 268 days.

(21) Appl. No.: 12/263,645

(22) Filed: Nov. 3, 2008

(65) Prior Publication Data

US 2010/0275482 A1 Nov. 4, 2010

(51) Int. Cl.
*F41A 25/00* (2006.01)

(52) U.S. Cl. ..... 42/1.06; 42/74

(58) Field of Classification Search ..... 42/1.06, 42/74

See application file for complete search history.

(56) References Cited

U.S. PATENT DOCUMENTS 2,731,753 A * 1/1956 Mathieu ..... 42/74
3,209,482 A * 10/1965 Kuzma et al. ..... 42/74
4,663,877 A * 5/1987 Bragg ..... 42/74
4,769,937 A * 9/1988 Gregory et al. ..... 42/74
4,910,904 A * 3/1990 Rose ..... 42/74
5,367,812 A * 11/1994 Lautrec ..... 42/74
5,752,339 A * 5/1998 Bentley et al. ..... 42/74
5,974,718 A * 11/1999 Bentley et al. ..... 42/74
6,688,031 B2 * 2/2004 Steele ..... 42/73
6,732,466 B2 * 5/2004 Bentley ..... 42/74
7,793,453 B1 * 9/2010 Sewell et al. ..... 42/73

* cited by examiner

*Primary Examiner* — Michael Carone
*Assistant Examiner* — Michael D David
(74) *Attorney, Agent, or Firm* — Zarian Midgley & Johnson PLLC

(57) ABSTRACT

A recoil suppression system for the stock of a firearm that includes an absorption assembly having an elongated body portion and a generally flat mounting plate having an outer periphery. The recoil suppression system includes a recoil housing with a piston ram, which is received into a cavity of the elongated body when the recoil housing is assembled with the absorption assembly. The mounting plate is generally shaped to fit the rear end of a firearm stock. A rearward projecting flange of the absorption assembly is adapted to fit within the recoil housing. The outer periphery of the mounting plate is equal to or larger than the outer periphery of the recoil housing. The absorption assembly may include a cam and torsion spring to reduce the recoil of the firearm. The recoil suppression system may include an adjustment mechanism to vary the preload force of the torsion spring.

9 Claims, 6 Drawing Sheets

RECOIL SUPPRESSION SYSTEM FOR THE STOCK OF A FIREARM

BACKGROUND OF THE INVENTION

1. Field of the Invention

The present invention relates generally to firearms and more specifically to a recoil suppression system for the stock of a firearm.

2. Description of the Related Art

One of the age old problems that has existed with firearms is the fact that many of them have severe recoil that affects the person firing the weapon. In firearms such as shotguns and rifles, for example, the rear end or butt of the stock is positioned against the shooter's shoulder and when discharging a shell, the recoil applies a centrifugal force to the firearm. The recoil force generally causes the front of the firearm to rise each time the weapon is fired. The amount of recoil may vary depending upon the amount of explosive powder in the shell being fired and may result in pain and/or bruising to the shooter's shoulder area. One example of when the recoil is detrimental to a shooter's accuracy is when the firearm is a shotgun being used for skeet shooting.

The best prior art recoil systems for the stock of a firearm have been very expensive, and the inexpensive systems typically are not effective in relieving the effects of the recoil resulting from firing a firearm. Two examples of expensive prior art recoil systems are a hydro-coil fluid dampening system and a pneumatic air chamber dampening system. Present day inexpensive recoil systems typically utilize one or more compression springs to absorb and dampen the recoil forces. If the compression spring is a little too-strong, more recoil results than if only the standard rifle recoil pad had been used. If the compression spring is not strong enough, some movement of the firearm will occur providing a similar result as if the firearm stock had been held against the shoulder too loosely.

U.S. Pat. No. 5,752,339 ("the '339 patent") issued to James K. Bentley and Willard H. Crawford, and U.S. Pat. No. 5,974,718 ("the '718 patent"), a continuation-in-part of the '339 patent, also issued to James K. Bentley and Willard H. Crawford, disclose a firearm recoil suppression system mounted at the rear or butt end of the firearm stock. The recoil suppression system of the '339 and '718 patents comprises a recoil suppressor assembly attached to the rear of a firearm stock and extending into a cavity provided in the rear portion of the stock. A recoil housing is attached over and secured to the suppressor assembly via an elongated piston mounted in a cavity provided in the suppressor assembly for reciprocal motion relative to the suppressor assembly. When the firearm is fired, the resulting recoil force causes the firearm stock to travel rearwardly into the recoil housing extending one or more coil springs to absorb the recoil force. After the recoil force has been minimized or dissipated, the extended spring or springs return the firearm stock to its initial forward static position.

While the recoil suppression system disclosed by the '339 and '719 patents overcomes many of the problems associated with earlier prior art recoil suppression systems as described above, the recoil suppression system includes a large number of components and is relatively complex and difficult to assemble. Further, the recoil suppression systems disclosed by the '339 and '719 patents require that the stock of the firearm enter the recoil housing. Thus, the recoil housing must have a larger outer profile than the stock to permit the stock to enter into the inner cavity of the recoil housing, which some users may view as aesthetically unappealing. Further, the movement of the stock into the recoil housing requires a different sized recoil housing for each different size of stock. It may be beneficial to provide a recoil system that could be adapted to various stocks.

In light of the foregoing, it would be desirable to provide a recoil suppression system for the rear or butt end of a firearm stock to minimize or dissipate the recoil force resulting from firing the firearm which includes relatively few components and is simple to assemble and install. Further, it may be desirable to provide a recoiled suppression system for the rear or butt end of a firearm stock that does not require the stock to slidably enter a recoil housing. It may be desirable to provide a recoil suppression system that may be easily modified to function with various sizes of firearm stocks.

The present invention is directed to overcoming, or at least reducing the effects of one or more of the issues set forth above.

SUMMARY OF THE INVENTION

In one embodiment, the present invention provides a recoil suppression system that may be mounted at the rear or butt end of a firearm stock which may minimize or dissipate the recoil force resulting from the firing of a firearm utilizing a recoil absorption assembly. The recoil suppression system of the present invention includes relatively few components and is simple to install and use.

Another embodiment may include a recoil absorption assembly having an elongated body portion with a forward end and a rearward end and a generally flat mounting plate having an outer periphery. The generally flat mounting plate may be disposed transversely to the elongated body portion at the rearward end thereof. The elongated body may have a cavity formed therein, the cavity being open at the rearward end of the elongated body portion. The mounting plate may include a rearward projecting flange located within the outer periphery of the mounting plate. The mounting plate may be generally shaped to fit the rear end of a firearm stock; the recoil absorption assembly may be received in a cavity formed within a portion of a firearm stock when the mounting plate is removably mounted on the rear end of the firearm stock.

The embodiment may further include a recoil housing having a rearward end, a forward end, and having a recoil plate at the rearward end with a forward projecting flange having an outer periphery. The outer periphery of the forward projecting flange is smaller than the outer periphery of the mounting plate of the recoil absorption assembly. The forward projecting flange of the recoil housing may be located substantially at the periphery of the recoil plate. The recoil plate and forward projecting flange may form a cavity that may be closed at its rearward end that may be shaped similarly to the recoil absorption assembly mounting plate and its rearward projecting flange. The recoil plate may include a piston ram member projecting forward, normal to the recoil plate. The piston ram member may have a shape generally similar to the cavity of the recoil absorption assembly. When the recoil absorption assembly and the recoil housing are assembled together, the piston ram may be received in the cavity of the elongated body and may be slidably attached to the recoil absorption assembly for reciprocal movement within the cavity of the elongated body. The rearwardly projecting flange of the mounting plate may be received within the cavity of the recoil housing when the piston ram is attached to the recoil absorption assembly.

The recoil suppression system may further comprise a recoil reduction means that may be configured to oppose movement of the piston ram into the cavity of the elongated body.

The recoil reduction means of the recoil suppression system may comprise a coil spring having a front end and a rear end. The front end of the coil spring may be detachably secured to the front end of the elongated body portion. The rear end of the coil spring may be secured to a front lever arm of a cam assembly that may have a rear lever arm that is pivotally secured to the front lever arm. The piston ram member may include a cavity formed in a side wall that receives a roller cam mounted to an end of the rear lever arm.

The recoil reduction means of the recoil suppression system may alternatively include a torsion spring having a free end and an attached end with the attached end of the torsion spring contacting at least a portion of a cam which may be pivotally mounted to the rear end of the elongated body portion. The piston ram member may include a cavity formed in a side wall that receives a portion of the cam. The torsion spring may oppose movement by the cam in at least one direction. The torsion spring may be attached to a first end of the cam and a roller cam may be mounted to a second end of the cam. The roller cam may be received in the cavity of the piston ram member. The torsion spring and the cam may be configured to pivot about the same axis. The cam may include a profile adapted to mate with a portion of the torsion spring.

The elongated body portion, the mounting plate, and the rearward projecting flange may be integrally formed as a single component. The recoil plate, the forward projecting flange, and the piston ram member may be integrally formed as a single unit.

The recoil suppression system may include a threaded stud protruding through a threaded bore hole formed in the mounting plate, such that the free end of the torsion spring abuts an end of the threaded stud which may allow the preload force of the torsion spring to be adjusted by rotating the threaded stud.

Another embodiment of a recoil suppression system may comprise a recoil absorption assembly which may have an elongated body portion. The elongated body portion has a first end and a second end. A mounting plate may be connected to the second end of the elongated body portion and a cavity may be formed within the elongated body portion and may be open at the second end of the elongated body portion and may extend through the mounting plate. The mounting plate may be adapted to be secured to a stock of a firearm and the elongated body portion may be configured to be received by a cavity formed within the firearm stock. A piston member may be slidably attached to the elongated body and may be configured to move within the cavity of the elongated body portion. A recoil housing may be connected to the piston member. The recoil housing may have a recoil plate and a forward projecting flange, which may form a cavity within the recoil housing. A cam having a first end and a second end, may be pivotally connected to the second end of the elongated body portion. The second end of the cam may be located within a cavity in the piston member and movement of the piston member within the cavity of the elongated body portion may pivot the cam. A torsion spring may be attached to the cam and may resist pivotal movement by the cam.

The recoil suppression system may further comprise an adjustment mechanism interfacing with at least a portion of the torsion spring which may vary the preload force of the torsion spring. The adjustment mechanism may comprise a threaded member threaded into a hole in the mounting plate, with an end of the threaded member engaging a portion of the torsion spring. Rotating the threaded member may vary the preload force of the torsion spring.

The recoil suppression system may further comprise a flange that projects rearwardly from the mounting plate. The flange may be within an outer periphery of the mounting plate. The flange of the mounting plate may be received within the cavity of the recoil housing and the outer periphery of the mounting plate is larger than or equal to an outer periphery of the forward projecting flange of the recoil housing.

The piston member may be connected to the recoil plate of the recoil housing. The torsion spring and cam may be configured to pivot about the same axis. The cam may comprise a profile adapted to mate with a portion of the torsion spring and may have a roller cam connected to the second end of the cam.

Another embodiment of a recoil suppression system may comprise a recoil absorption assembly configured to be received by a stock of a firearm. The recoil absorption assembly may comprise a mounting plate with an outer periphery connected to an end of an elongated body portion. The elongated body portion may have a cavity formed therein that may extend through the elongated body portion and the mounting plate. The recoil suppression system may further comprise a recoil housing, which may comprise a piston member that may extend forward from a recoil plate and may be slidably connected to the recoil absorption assembly. The recoil plate may have a forward projecting flange with an outer periphery. The recoil suppression system may further comprise a recoil reduction means configured to oppose movement of the piston member in the direction in which the cavity extends. The outer periphery of the forward projecting flange may be within or about equal to the bounds of the outer periphery of the mounting plate. The recoil reduction means may comprise a torsion spring and cam, or alternatively, may comprise a coil spring and cam assembly. The recoil suppression system may further comprise an adjustment mechanism which may comprise a threaded member. Rotating the threaded member may vary a preload force of the recoil reduction means.

Other embodiments and advantages of the present invention will be readily appreciated as the same become better understood by reference to the following detailed description, taken in conjunction with the accompanying drawings. The claims alone, not the preceding summary or the following detailed description, define the invention.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the following detailed description illustrate by way of example the principles of the present invention. The components in the drawings are not necessarily to scale, emphasis instead being placed upon clearly illustrating the principles of the present invention. In the drawings like reference numbers indicate identical or functionally similar elements throughout the several views thereof, and wherein.

Figure 1:
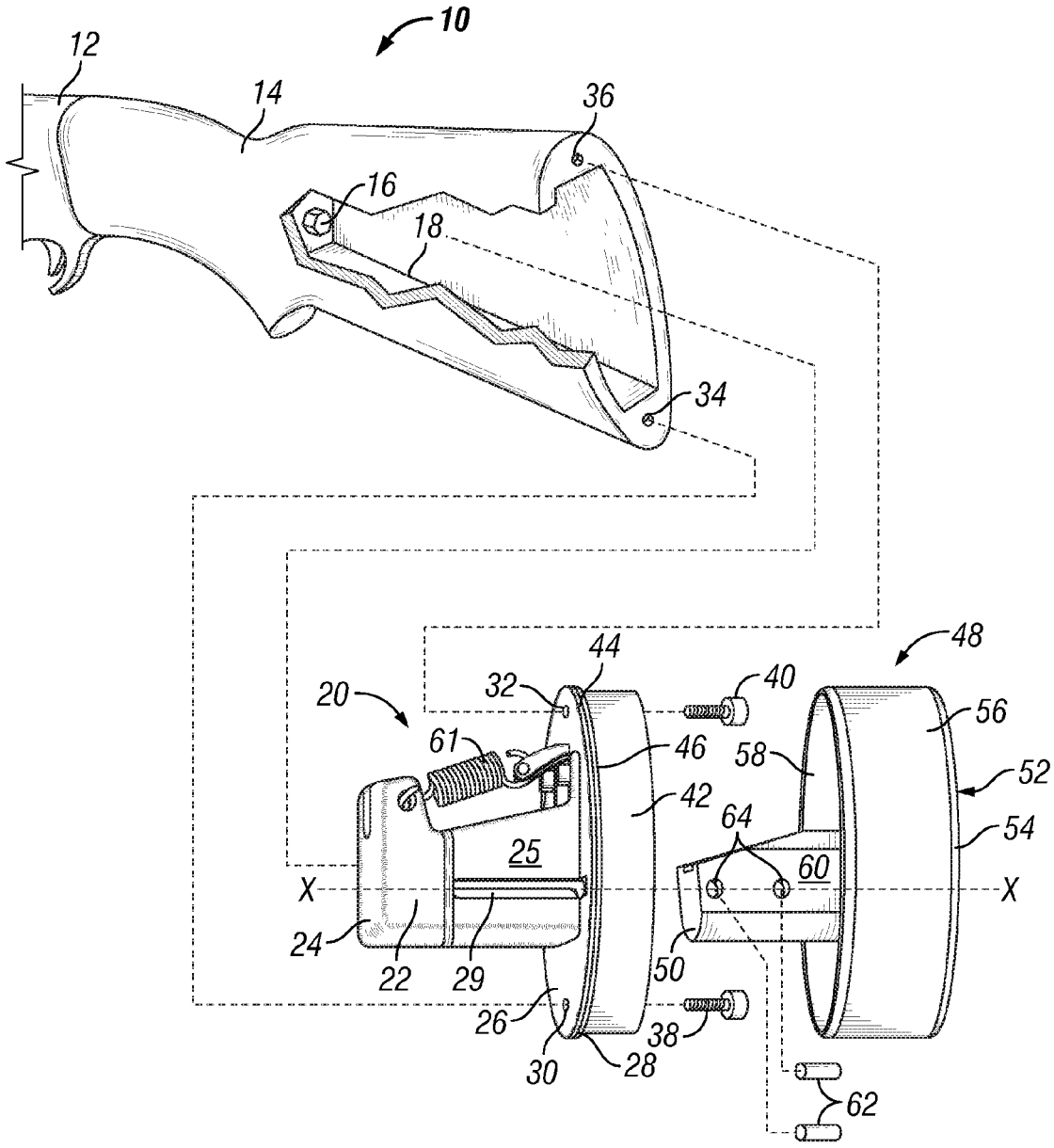
FIG. 1 is an exploded perspective view of the recoil system illustrating the overall structure of an embodiment of the present invention.

While the present invention is susceptible to various modifications and alternative forms, specific embodiments have been shown by way of example in the drawings and will be described in detail herein. However, it should be understood that the present invention is not intended to be limited to the particular forms disclosed. Rather, the present intention is to cover all modifications, equivalents and alternatives falling within the spirit and scope of the present invention as defined by the appended claims.

DETAILED DESCRIPTION OF ILLUSTRATIVE EMBODIMENTS

Illustrative embodiments of the invention are described below as they might be employed in a firearm recoil suppression system. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As shown in the drawings for purposes of illustration, an embodiment of the present invention is a firearm recoil suppression system that includes a recoil absorption assembly that is removeably attached to and received in a cavity provided in the rear or butt end of a firearm stock with a recoil housing slidingly attached to the recoil absorption assembly via a piston ram member. The piston ram member is received for reciprocal motion in a cavity provided in the recoil absorption assembly body. A firearm recoil suppression system embodying the present invention minimizes or dissipates the recoil force resulting from firing the firearm thus greatly reducing or eliminating the resulting shock to a shooter's shoulder and improving the shooter's accuracy.

Further aspects and advantages of the various embodiments of the invention will become apparent from consideration of the following description and drawings.

Referring now to FIGS. 1-4, a firearm 10, which may be a shotgun or a high-powered rifle, for example, having a receiver 12 and a stock 14. The stock 14 may be of any conventional material, such as wood or composite, such as plastic, for example. The stock 14 is typically removeably attached to the receiver 12 by any suitable means, such as a bolt 16 through a bore hole (not shown), for example. Typically, a composite stock will have a cavity 18 formed within; however, if a wooden stock is used, typically it will be solid and the cavity 18 will have been bored out prior to installing the recoil suppression system.

A recoil absorption assembly 20 has an elongated body portion 22 having a longitudinal axis, shown as X-X in FIG. 1. The body portion 22 has a front or forward facing (with respect to the firearm) wall 24 and a rear wall 26. Rear wall 26 forms the forward face of a mounting plate 28 which extends transversely, normal to, the elongated body portion 22. The elongated body portion 22 has a cavity 27 (as shown in greater detail in FIG. 4) formed within, closed at the front wall 24 and extending through and open at the mounting plate 28. The mounting plate 28 may be formed integrally with the body portion 22, such as cast or machined from a single block, for example, or, alternately, the body portion 22 and the mounting plate 28 may be fabricated separately and then assembled. A pair of bore holes 30, 32 through the mounting plate 28 align with respective threaded bore holes 34, 36 in the rear end of the stock 14 and threaded bolts 38, 40 detachably secure the mounting flange 28 to the rear end of the stock 14. A flange 42 extends rearwardly and normal to the mounting plate 28 about the periphery 44 of the mounting plate 28. An edge 46 (as shown in greater detail in FIGS. 2A and 4) extends outwardly from the flange 42 where it joins the mounting plate 28. The flange 42 may be formed integrally with mounting plate 28 and the elongated body portion 22 such as by casting or machining or, alternately, may be fabricated separately and then attached to the mounting plate 28 by any suitable means, such as welding or brazing, for example.

Figure 2A:
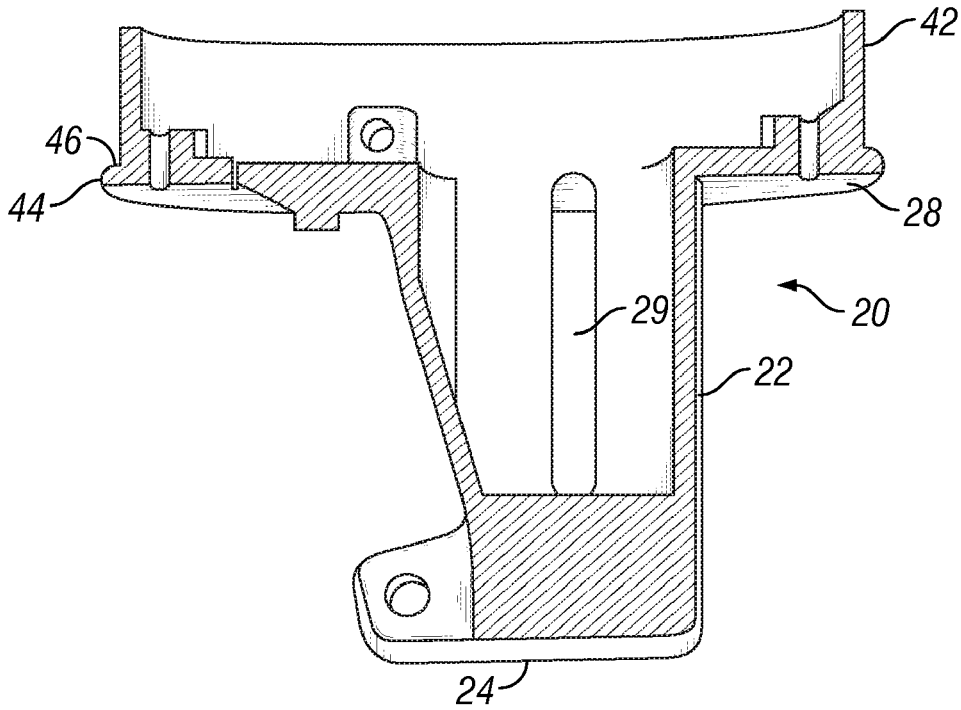
FIG. 2A is a cross-sectional view showing the structure a recoil absorption assembly according to an embodiment of the present invention.
Figure 2B:
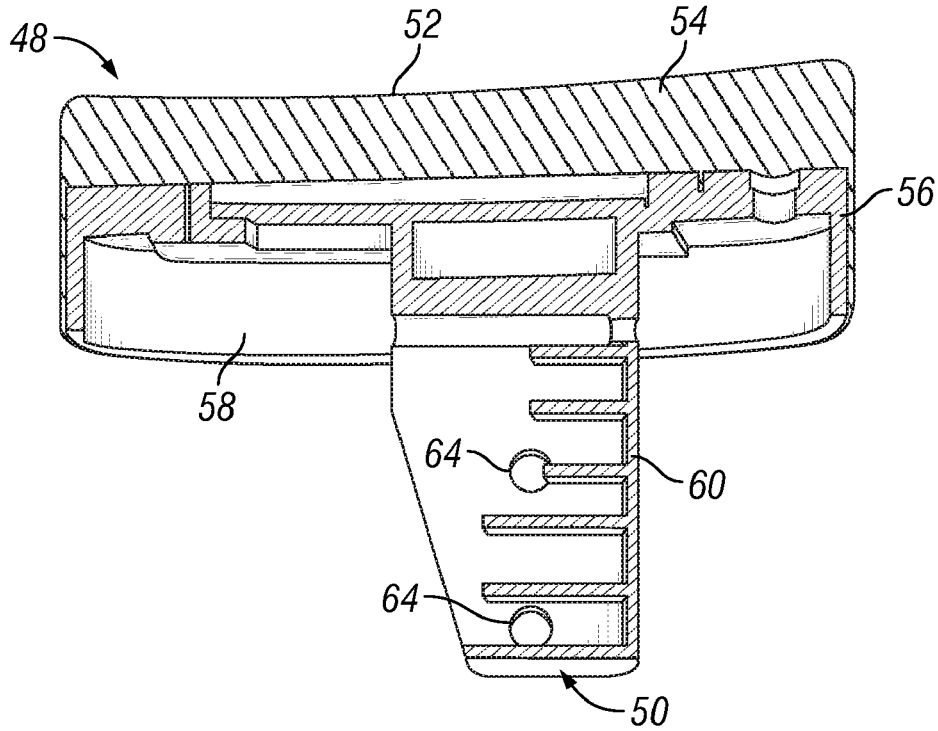
FIG. 2B is a cross-section view showing the structure of a recoil housing according to an embodiment of the present invention.

A recoil housing 48, as shown in FIG. 2B, has a forward end 50, a rearward end 52, and a recoil plate 54 at the rearward end 52. A forward projecting flange 56 at the peripheral of the recoil plate 54 forms a cavity 58 closed at its rearward end 52 by the recoil plate 54 and shaped similarly to the recoil absorption assembly mounting plate 28 and its rearward projecting flange 42. A piston ram 60 projects forwardly from and normal to the recoil plate 54. The piston ram 60 is shaped generally similar to the recoil absorption assembly cavity 27 and is received in the elongated body cavity 27 when the recoil housing 48 is assembled with the recoil absorption assembly 20. The piston ram 60 is slidingly attached to the recoil absorption assembly 20 by one or more pins 62 through a slot 29 (shown in FIG. 2A) formed in a sidewall 25 of the body portion 22 and one or more bore holes 64 formed in the piston ram 60 for reciprocal movement within the body portion cavity 27. The rearward projecting flange 42 of the recoil absorption assembly 20 is received in the cavity 58 of the recoil housing 48 when the piston ram 60 is inserted into the cavity 27 of the body portion 22 and attached to the recoil absorption assembly 20 (as shown in greater detail in FIGS. 3 and 4).

The recoil suppression system may further comprise a recoil reduction means. The recoil reduction means may comprise a coil spring 61 which may have a rear end 75 and a front end 63 which may be inserted through and secured in an aperture 65 at the front end 24 of the body portion 22. The recoil reduction means may further comprise a cam assembly 66 that may have a front lever arm 68 and a rear lever arm 70 that are pivotally attached together by a pin 72. The front lever arm 68 has an aperture 74 formed at a first end for receiving the rear end 75 of coil spring 61. The rear lever arm 70 may be located in a cavity 78 formed in the rear wall 28 and may be pivotally attached to the rear wall 28 by a pin 76. The rear lever arm 70, in its static position, normally has a first end 71 received within aperture 78 and a second end 77 disposed within a cavity 80 formed in a side wall of the piston ram 60. A roller cam 82 is mounted on a pin 84 passing through the second end 77 of the rear lever arm 70.

To assemble and install the recoil suppressor system of the present invention, the existing butt plate or recoil pad (not shown) originally installed at the rear or butt end of the firearm stock 14 is removed and set aside. The firearm stock 14 may already have a cavity 18 formed therein; however, if the stock 14 is solid, as is typically the case with a stock fabricated from a single block of wood, the cavity 18 will have to be bored prior to proceeding. The elongated body portion 22 of the recoil absorption assembly 20 is first inserted in the cavity 18 and the mounting plate 28 is matched to the rear end of the stock 14. The mounting plate edge 46 may then have to be sized and shaped to fit the rear end of the stock 14 such as by filing or grinding, for example, or by other suitable means. Because the mount plate edge 46 may be adapted to fit various sizes of stocks, a smaller number of differently sized recoil absorption assemblies may be made available to accommodate various stock sizes and shapes in comparison to the recoil housing configuration previously disclosed in the '339 and '718 patents.

The recoil absorption assembly 20 is then removed from the cavity 18 of the stock 14. The recoil housing 48 is then attached to the recoil absorption assembly 20 by slidingly inserting the piston ram 60 into the cavity 27 of the elongated body portion 22 along the longitudinal axis X-X. The pins 62 are then inserted through the bore holes 64 with the ends of the pins 62 extending into the slot 29, attaching the recoil housing 48 to the recoil absorption assembly 20 and allowing sliding, reciprocal movement of the piston ram 60 within the cavity 27 of the elongated body portion 22. The now assembled recoil suppressor system is then installed in the firearm stock 14 by inserting the elongated body portion 22 into the stock cavity 18 until the mounting plate 28 abuts the rear end of the stock 14. The threaded bolts 38 and 40 are then inserted, via apertures 53 and 55 in the recoil plate 54, through mounting plate bore holes 30 and 32, respectively, and into threaded bore holes 34 and 36 in the rear end of the stock 14 to detachably secure the mounting plate 28 to the rear or butt end of the stock 14. Alternatively, the recoil suppressor system may be preassembled as a single assembly and may be preconfigured to be mounted to the rear of the firearm stock 14 and used without further configuration.

Figure 3:
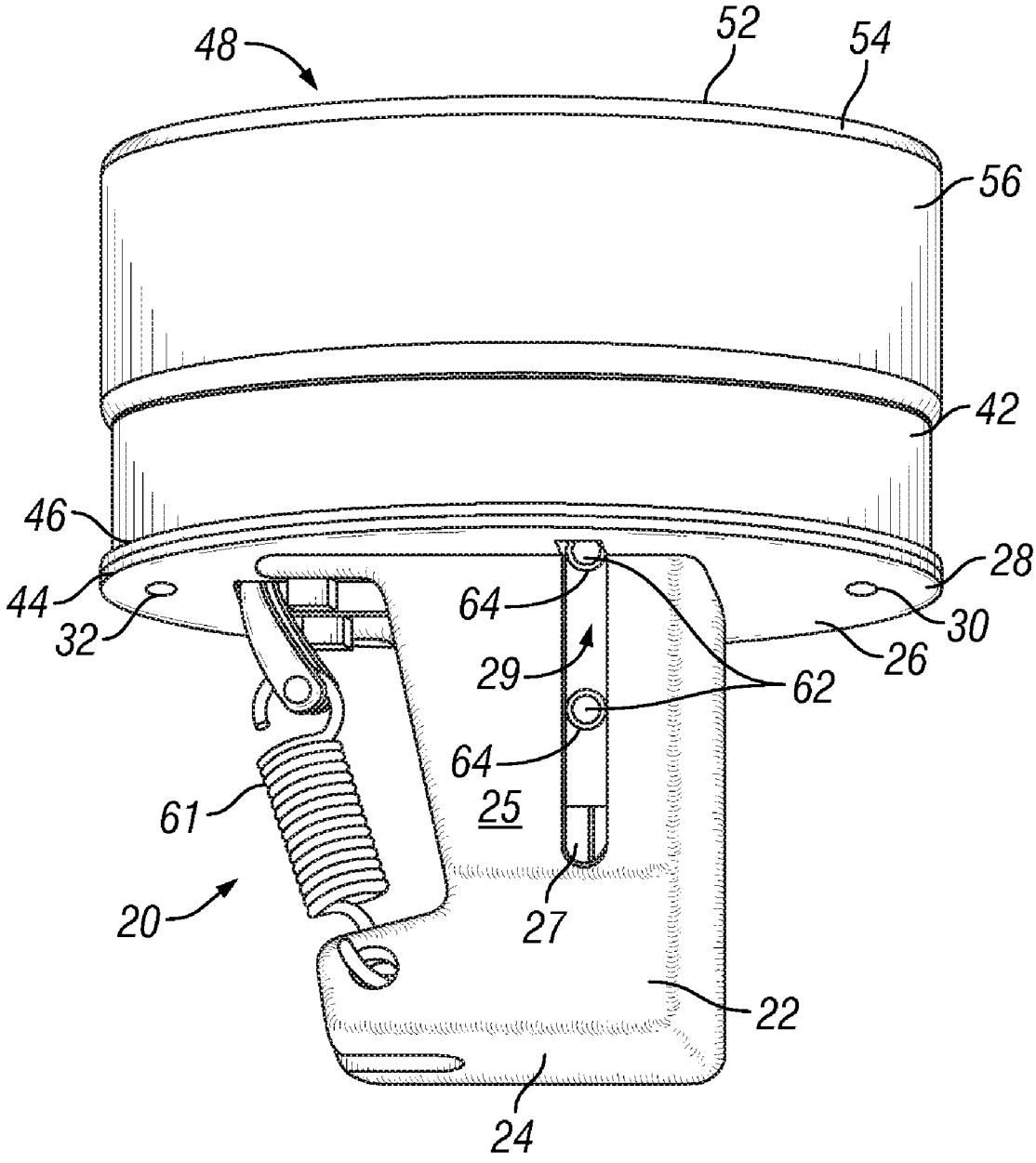
FIG. 3 is a perspective view of the recoil system illustrating the assembly of an embodiment of the present invention.
Figure 4:
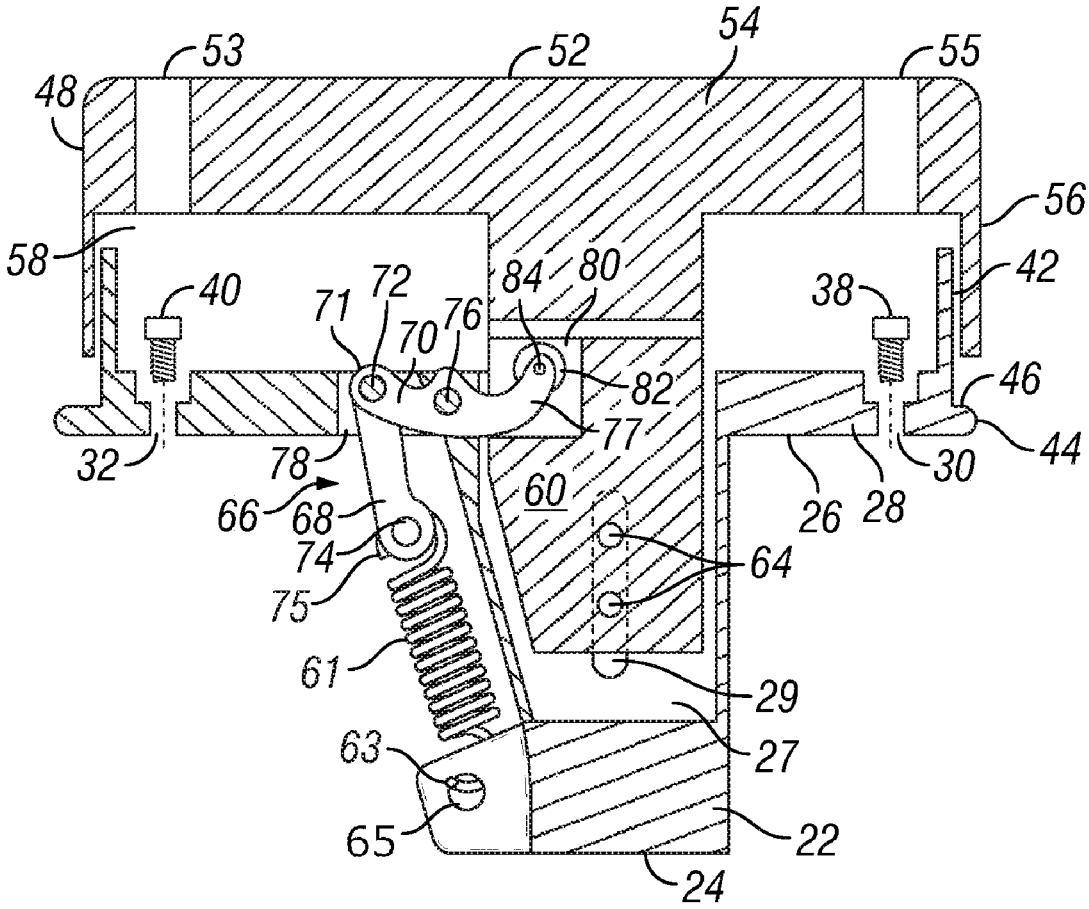
FIG. 4 is a cross-sectional view of the recoil system illustrating the details of an embodiment of the present invention.

When assembled and attached at the rear or butt end of a firearm stock 14, the recoil suppression system of the present invention initially is in a static position. As shown in FIGS. 3 and 4, in the static position the flange 42 of the mounting plate 28 is partially inserted in the recoil housing cavity 58 and the first end 71 of the rear lever arm 70 is disposed within the cavity 78 of the mounting plate 28. When the firearm is fired, the force of the recoil drives the stock 14 rearward into the shoulder of the shooter which, in turn, drives the flange 42 of the mounting plate 28 further into the recoil housing cavity 58. As this rearward motion is occurring, the elongated body portion 22 travels rearwardly so that the front end 50 of piston ram 60 approaches the front end of body portion 22 within the cavity 27. The roller cam 82, at the same time, travels along the inner surface of the cavity 80 causing the rear lever arm 70 to pivot about the hinge pin 76 extending the coil spring 61. Once the recoil force has been dampened or dissipated, the coil spring 61 pulls the front lever arm 68 forward causing the rear lever arm 70 to pivot back to its original static position prior to the firing of the firearm.

Figure 5:
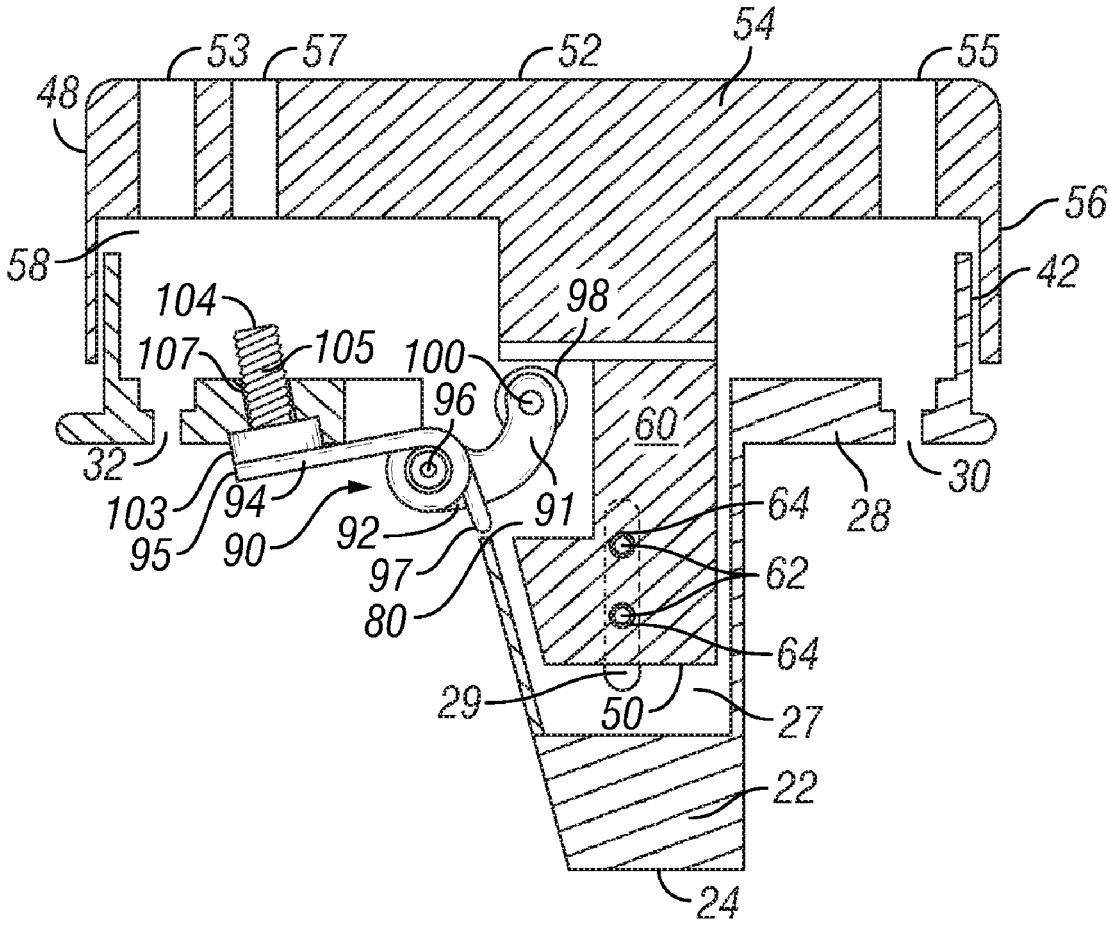
FIG. 5 is a cross-section view of the recoil system illustrating the details of an alternate embodiment of the present invention.
Figure 7A:
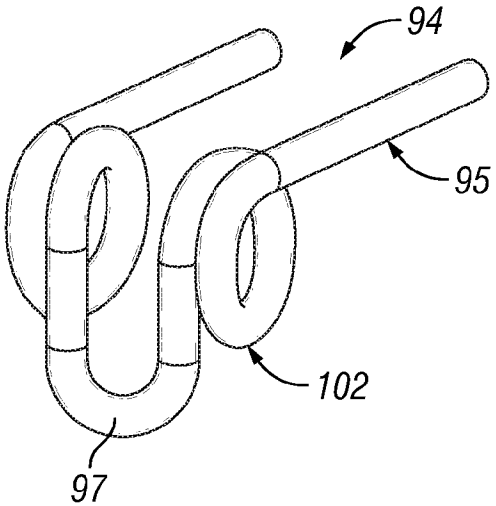
FIGS. 7A-7D is perspective views illustrating various for the torsion spring of an embodiment of the present invention.
Figure 6:
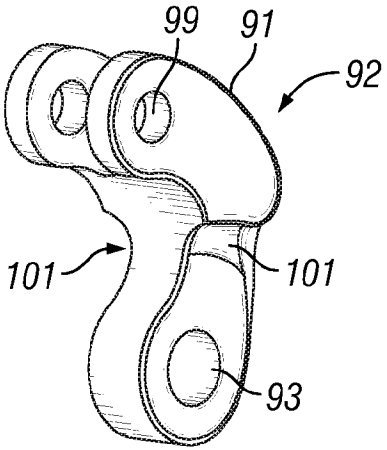
FIG. 6 is a perspective view illustrating the cam assembly of an embodiment of the present invention.
Figure 7D:
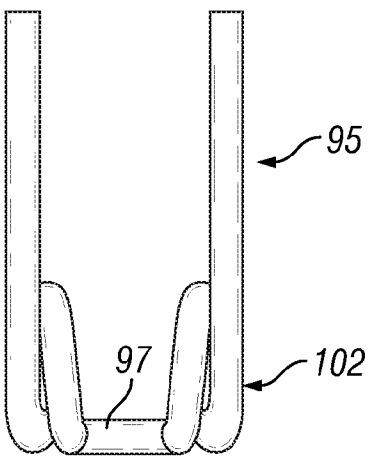
Figure 7C:
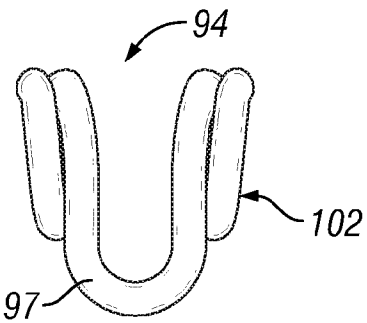
Figure 7B:
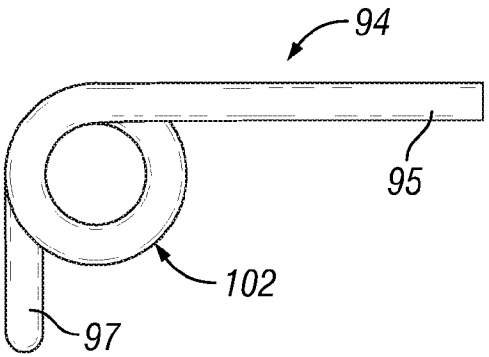

Referring now also to FIGS. 5, 6 and 7A-7D, an alternate embodiment of the recoil suppression system according to the present invention is shown. The structure of the recoil absorption assembly 20 and the recoil housing 48 is similar to that described above with reference to FIGS. 1-4 and will not be repeated here. In the alternate embodiment illustrated, the recoil reduction means is now embodied by a cam assembly 90, as shown in FIG. 5.

The cam assembly 90 includes a cam 92 and a torsion spring 94 (shown in greater detail in FIGS. 7A-7D) pivotally attached together and to a wall of the elongated body portion 22 by a hinge pin 96 through a cam bore hole 93 (shown in FIG. 6) on a first end of the cam 92 and a curl 102 of the torsion spring 94. As shown, the torsion spring 94 may be formed from a rod of spring steel or other suitable material of appropriate dimensions. In some embodiments, the shorter end 97 of the torsion spring 94 may be retained or captured within a depression or groove 101 formed in the side of the cam 92 (as shown in greater detail in FIG. 6). The free or longer end 95 of the torsion spring 94 abuts the head 103 of adjustment stud 105; alternately, the free end 95 of the torsion spring 94 may abut the rear wall 26 (shown in FIG. 1). The adjustment stud 105 may be a threaded screw or threaded bolt, or other suitable threaded rod, and is inserted through the mounting plate 28 in internally threaded bore hole 107. The adjustment stud 105 has a flat surface or head 103 at one end and a slot or other means formed in the opposite end 104 to allow the stud to be turned or rotated in threaded bore hole 107. The second end 91 of the cam 92 is disposed within a cavity 80 formed in a side wall of piston ram 60. A roller cam 98 is mounted on a pin 100 passing through a bore hole 99 at the second end 91 of the cam 92. One benefit of the disclosed torsion spring 94 and cam 92 configuration is that the torsion spring 94 loads and rebounds along the same arc or path as that of the cam 92. Movement in the same path eliminates the potential need to dampen the rebound of the spring mechanism as it moves the recoil absorption assembly 20 back to the initial or static position. Thus, there may be little or no stored energy within the torsion spring 94, which may allow the torsion spring 94 to substantially dampen or absorb the recoil of the firearm with a reduced rebound.

Assembly and functioning of the recoil suppressor system utilizing the torsion spring 94 is similar to the assembly and functioning of the recoil suppressor system when utilizing the coil spring 61 as described above and will not be repeated in detail here. The preload force of the torsion spring 94 can be adjusted for optimal recoil shock suppression by adjusting the position of adjustment stud 105 using a screw driver, or other suitable tool, through aperture 57 formed in recoil plate 54.

Although various embodiments have been shown and described, the invention is not so limited and will be understood to include all such modifications and variations as would be apparent to one skilled in the art.

What is claimed is:

1. A recoil suppression system comprising:

a recoil absorption assembly having an elongated body portion with a forward end and a rearward end with a generally flat mounting plate having an outer periphery, the mounting plate disposed transversely to the elongated body portion at the rearward end thereof, the elongated body having a cavity formed therein, the cavity being open at the rearward end of the elongated body portion, the mounting plate having a rearward projecting flange located within the outer periphery of the mounting plate, the recoil absorption assembly being received in a cavity formed within a firearm stock when the mounting plate is mounted on a rear end of the firearm stock;

a recoil housing having a rearward end, a forward end, and having a recoil plate at the rearward end with a forward projecting flange having an outer periphery, the forward projecting flange being at a periphery of the recoil plate, the recoil plate and forward projecting flange forming a cavity closed at the rearward end of the recoil housing and shaped similarly to the mounting plate and its rearward projecting flange, a piston ram member projecting forwardly from and being normal to the recoil plate, the piston ram member being receivable in the cavity of the elongated body portion and slidingly attached to the recoil absorption assembly for reciprocal movement in the cavity, the rearward projecting flange being received in the recoil housing cavity when the piston ram is attached to the recoil absorption assembly; and a recoil reduction means configured to oppose the movement of the piston ram into the cavity of the elongated body, wherein the recoil suppression system is configured to be received by the stock of a firearm, and wherein at least a portion of the outer periphery of the mounting plate is larger than the outer periphery of the forward projecting flange.

2. The recoil suppression system of claim 1, wherein the recoil reduction means comprises a coil spring having a front end and a rear end, the front end of the coil spring being detachably secured to the front end of the elongated body portion, a cam assembly having a rear lever arm that is pivotally secured to an end of a front lever arm, the rear end of the coil spring being secured to the front lever arm, the piston ram member having a cavity formed in a side wall that receives a roller cam mounted on an end of the rear lever arm.

3. The recoil suppression system of claim 1, wherein the recoil reduction means comprises a torsion spring having a free end and an attached end, with the attached end of the torsion spring contacting at least a portion of a cam which is pivotally mounted to the rear end of the elongated body portion, the piston ram member including a cavity formed in a side wall that receives a portion of the cam, wherein the torsion spring opposes movement by the cam in at least one direction.

4. The recoil suppression system of claim 3, wherein the torsion spring is attached to a first end of the cam and a roller cam is mounted to a second end of the cam, the roller cam being received in the cavity of the piston ram member.

5. The recoil suppression system of claim 3 further comprising a threaded stud inserted through a threaded bore hole formed in the mounting plate, wherein the free end of the torsion spring abuts an end of the threaded stud, a preload force in the torsion spring being adjustable by the rotation of the threaded stud.

6. The recoil suppression system of claim 3, wherein the torsion spring and cam are configured to pivot about the same axis.

7. The recoil suppression system of claim 3, wherein the cam includes a profile adapted to mate with a portion of the torsion spring.

8. The recoil suppression system of claim 1 wherein the elongated body portion, the mounting plate, and the rearward projecting flange are integrally formed as a single component.

9. The recoil suppression system of claim 1 wherein the recoil plate, the forward projecting flange, and the piston ram member are integrally formed as a single component.

* * * * *